US009226622B2

(12) United States Patent
Le

(10) Patent No.: US 9,226,622 B2
(45) Date of Patent: Jan. 5, 2016

(54) TWO POINT DOOR LATCH WITH TAPERED PINS

(71) Applicant: Tam Le, Santa Ana, CA (US)

(72) Inventor: Tam Le, Santa Ana, CA (US)

(73) Assignee: S.P.E.P. Acquistion Corp., Long Beach, CA (US)

( * ) Notice: Subject to any disclaimer, the term of this patent is extended or adjusted under 35 U.S.C. 154(b) by 268 days.

(21) Appl. No.: 14/059,232

(22) Filed: Oct. 21, 2013

(65) Prior Publication Data

US 2015/0108768 A1 Apr. 23, 2015

(51) Int. Cl.

| | |
|---|---|
| ***E05C 1/06*** | (2006.01) |
| ***A47K 3/00*** | (2006.01) |
| ***E05C 9/04*** | (2006.01) |
| ***E05B 53/00*** | (2006.01) |
| ***E05B 63/14*** | (2006.01) |
| ***E05B 15/10*** | (2006.01) |
| *E05C 1/12* | (2006.01) |

(52) U.S. Cl.

CPC ..... *A47K 3/006* (2013.01); *E05B 15/101* (2013.01); *E05B 53/00* (2013.01); *E05B 63/143* (2013.01); *E05C 9/043* (2013.01); *E05C 9/046* (2013.01); *Y10T 292/0837* (2015.04)

(58) Field of Classification Search

CPC ..... Y10T 292/0837; Y10T 292/1015; Y10T 292/0806; Y10T 292/084; Y10T 292/0964; Y10T 292/0974; Y10T 292/1016; Y10T 70/523; Y10T 292/0892; Y10T 292/0963; Y10T 16/5445; Y10T 16/5448; Y10T 292/0961

USPC ..... 292/34, 4–6, 36, 57, 59, 158, 159, 292/169.13

See application file for complete search history.

(56) References Cited

U.S. PATENT DOCUMENTS 1,635,714 A * 7/1927 Hoffman ..... E05C 9/045 292/37

5,911,763 A * 6/1999 Quesada ..... E05C 9/043 292/36

* cited by examiner

*Primary Examiner* — Mark Williams

(74) *Attorney, Agent, or Firm* — Karish & Bjorgum, PC

(57) ABSTRACT

A two point door latch device having a master latch assembly, an auxiliary latch assembly, a linkage operationally joining the master latch assembly and the auxiliary latch assembly, and a handle for operating the master latch assembly. Both the master latch assembly and the auxiliary latch assembly have bolts with beveled heads that extend from their respective housings or brackets when in a locked state, and both include springs which tend the bias the bolts to their unlocked states absent the handle being in the lock position. Furthermore, if the linkage becomes disconnected from the master latch assembly and/or the auxiliary latch assembly, or the linkage breaks, the springs will cause the bolts of the master latch assembly and the auxiliary latch assembly to be retracted to an opened state.

14 Claims, 13 Drawing Sheets

TWO POINT DOOR LATCH WITH TAPERED PINS

FIELD OF THE INVENTION

The invention relates to the field of door latches, and particularly relates to a door latching mechanism with at least two latch assemblies that are operably connected by a linkage arm, the latch assemblies being operated by a single handle and including a safety automatic unlock feature to prevent locking of a door in case the linkage fails. Furthermore, each latch assembly has a tapered pin that applies a gradually changing closing force to a door as it is being closed. More particularly, the invention relatives to a two point door latch with tapered pins.

BACKGROUND OF THE INVENTION

Door latching mechanisms with at least two latch assemblies are useful in certain applications where it is desirable to have multiple latch points. One such increasingly important application is in the area of walk-in bathtubs. Walk-in bathtubs feature a door with a gasket. The door opens either inwardly or outwardly. When the door is open, the user can basically walk into the bathtub without having to step over the otherwise relatively high wall of the bathtub. When the door is shut, its gasket will ride against a complementary opening is the tub, thereby forming a watertight seam. Walk-in bathtubs are growing in popularity with invalid patients, people with ambulatory problems, and those who simply prefer easy ingress and egress from a bathtub.

When a walk-in bathtub is filled with water, a considerable amount of water pressure builds up from the 40-50 gallon capacity contained therein. If the door of a walk-in accidental pops open, or the gasket leaks, there is a potential for considerable water damage. Even a slight leak or any dripping whatsoever is unacceptable to manufacturers and consumers alike of walk-in bathtubs. Accordingly, many walk-in bathtubs are fitted with more than one latch to ensure good sealing along the entire door/door frame interface. For ease of operation, some prior art multi-latch door latching mechanisms had one latch assembly carry the door handle (master latch assembly) with the other latch assembly (slave latch assembly) being operably connected to the master latch assembly with a linkage.

With prior art door latching mechanisms having at least two latch assemblies connected with a linkage, if the linkage breaks, gets out of alignment, or otherwise becomes disabled, it is possible that one or more of the latch assemblies can become stuck in a locked position, preventing the door from being opened. Another problem with prior art door latching mechanisms having at least two latch assemblies is that they are not generally designed to provide for even closing of the door along the location of each latch, and thus, leakage along the seal can sometimes occur.

There accordingly remains a need for new designs of door latching mechanisms having at least two latch assemblies that prevent inadvertent locking of the door upon failure of the linkage, and also provide even sealing of a door with a door frame.

SUMMARY OF THE INVENTION

The present invention relates generally to a two point door latch device, comprising: a master latch assembly having (a) an outer housing, (b) a handle adapter that rotatably extends into the outer housing, (c) a master bolt with proximal end and a distal end, the master bolt slidably passing into the outer housing, the proximal end having a guide pin, and (d) a cam plate with a rotation hole, an arch shaped slot with a first terminal end and a second terminal end, the first terminal end being further away from the rotation hole than is the second terminal end, and a master pivot, wherein the cam plate is rotatably retained within the outer housing and is rotationally connected to the handle adapter, and wherein the guide pin of the master bolt slides in the arch shaped slot of the cam plate between the first terminal end of the arch-shaped slot wherein the master bolt moves into the outer housing, and the second terminal end of the arch-shaped slot wherein the master bolt moves out of the outer housing; an auxiliary latch assembly having (a) a bracket assembly with a bottom wall and an upper end, and (b) an auxiliary bolt with a proximal end having an auxiliary pivot thereon, and a distal end, the auxiliary bolt being slidable in the bracket assembly with proximal end extendable above the upper end of the bracket and the distal end extending below the bottom wall of the bracket assembly; and a linkage that connects between the master pivot of the master latch assembly and the auxiliary pivot of the auxiliary latch assembly, wherein activation of the master latch assembly activates the auxiliary latch assembly.

The invention further provides a two point door latch device, comprising: a master latch assembly having (a) a housing, (b) a handle adapter that passes into the housing, (c) a master bolt with proximal end and a distal end, the distal end having a beveled face, the master bolt slidably passing into the housing, and (d) a cam plate with a rotation hole, a guide with a first end and a second end, the first end being spaced further away from the rotation hole than is the second end, and a master guide follower, wherein the cam plate is rotatably retained within the housing and is connected to the handle adapter, and wherein the proximal end of the master bolt slides relative to the guide of the cam plate between the first end where the master bolt moves into the outer housing, and the second end where the master bolt moves out of the housing; an auxiliary latch assembly having (a) a bracket assembly with a bottom wall and an upper end, and (b) an auxiliary bolt with a proximal end having an auxiliary pivot thereon, and a distal end with a beveled face, the auxiliary bolt being slidable in the bracket assembly with proximal end extendable above the upper end of the bracket and the distal end extending below the bottom wall of the bracket assembly; and a linkage that connects between the master pivot of the master latch assembly and the auxiliary pivot of the auxiliary latch assembly, wherein activation of the master latch assembly activates the auxiliary latch assembly.

In another embodiment the invention provides a two point door latch device, comprising: a master latch assembly having (a) an outer housing, (b) a handle adapter that rotatably extends into the outer housing, (c) a master bolt with proximal end and a distal end, the master bolt slidably passing into the outer housing, the proximal end having a guide pin, (d) a tension spring that connects between the master bolt and the housing, which tension spring tends to bias the master bolt into the housing and rotate the cam plate to exert a pulling force on the linkage connected to the cam plate and tends to pull the auxiliary bolt into the bracket assembly and into an unlocked position, and (e) a cam plate with a rotation hole, an arch shaped slot with a first terminal end and a second terminal end, the first terminal end being further away from the rotation hole than is the second terminal end, and a master pivot, wherein the cam plate is rotatably retained within the outer housing and is rotationally connected to the handle adapter, and wherein the guide pin of the master bolt slides in the arch shaped slot of the cam plate between the first terminal end of the arch-shaped slot wherein the master bolt moves into the outer housing, and the second terminal end of the arch-shaped slot wherein the master bolt moves out of the outer housing; an auxiliary latch assembly having (a) a bracket assembly with a bottom wall and an upper end, (b) an auxiliary bolt with a proximal end having an auxiliary pivot thereon, and a distal end, the auxiliary bolt being slidable in the bracket assembly with proximal end extendable above the upper end of the bracket and the distal end extending below the bottom wall of the bracket assembly, and (c) a tension spring that connects between the master bolt and the housing, which tension spring tends to bias the master bolt into the housing and rotate the cam plate to exert a pulling force on the linkage connected to the cam plate and tends to pull the auxiliary bolt into the bracket assembly and into an unlocked position; and a linkage that connects between the master pivot of the master latch assembly and the auxiliary pivot of the auxiliary latch assembly, wherein activation of the master latch assembly activates the auxiliary latch assembly.

DETAILED DESCRIPTION

Figure 1A:
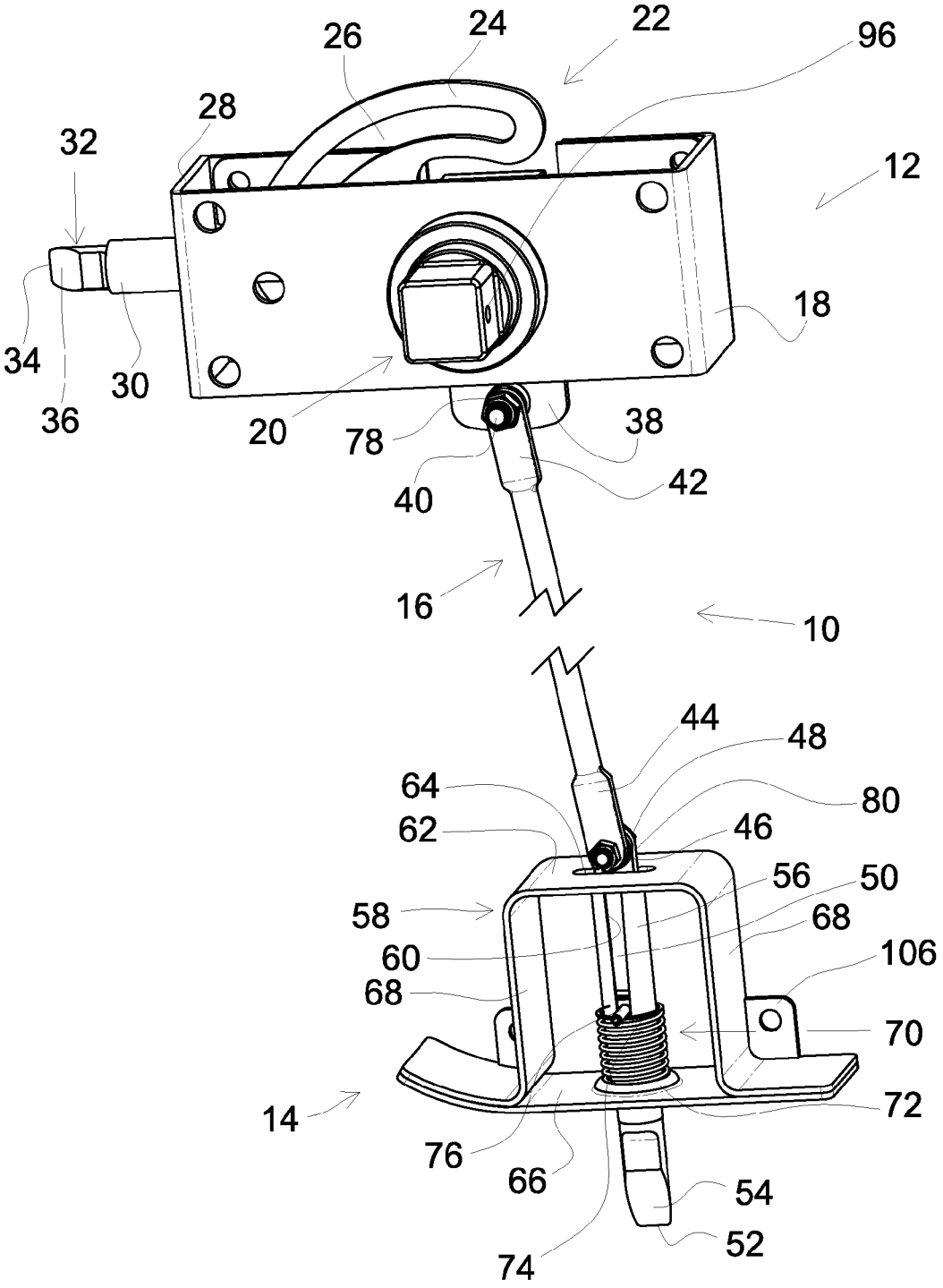
FIG. 1A is a front right isometric view of an exemplary embodiment a two point door latch with tapered pins of the invention showing its master latch assembly and its auxiliary latch assembly in a locked state.
Figure 1B:
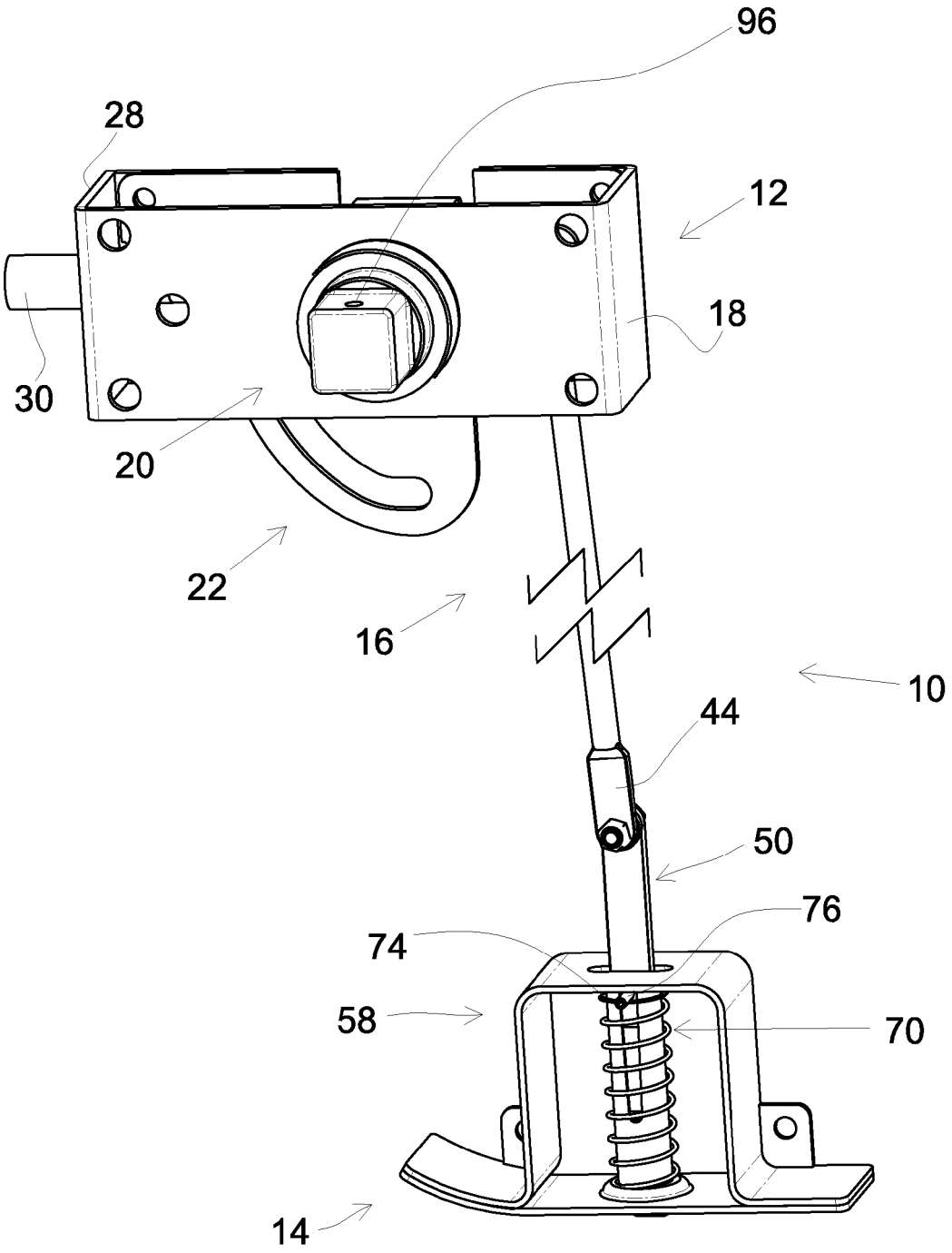
FIG. 1B is a front right isometric view of an exemplary embodiment a two point door latch with tapered pins of the invention showing its master latch assembly and its auxiliary latch assembly in an unlocked state.
Figure 3:
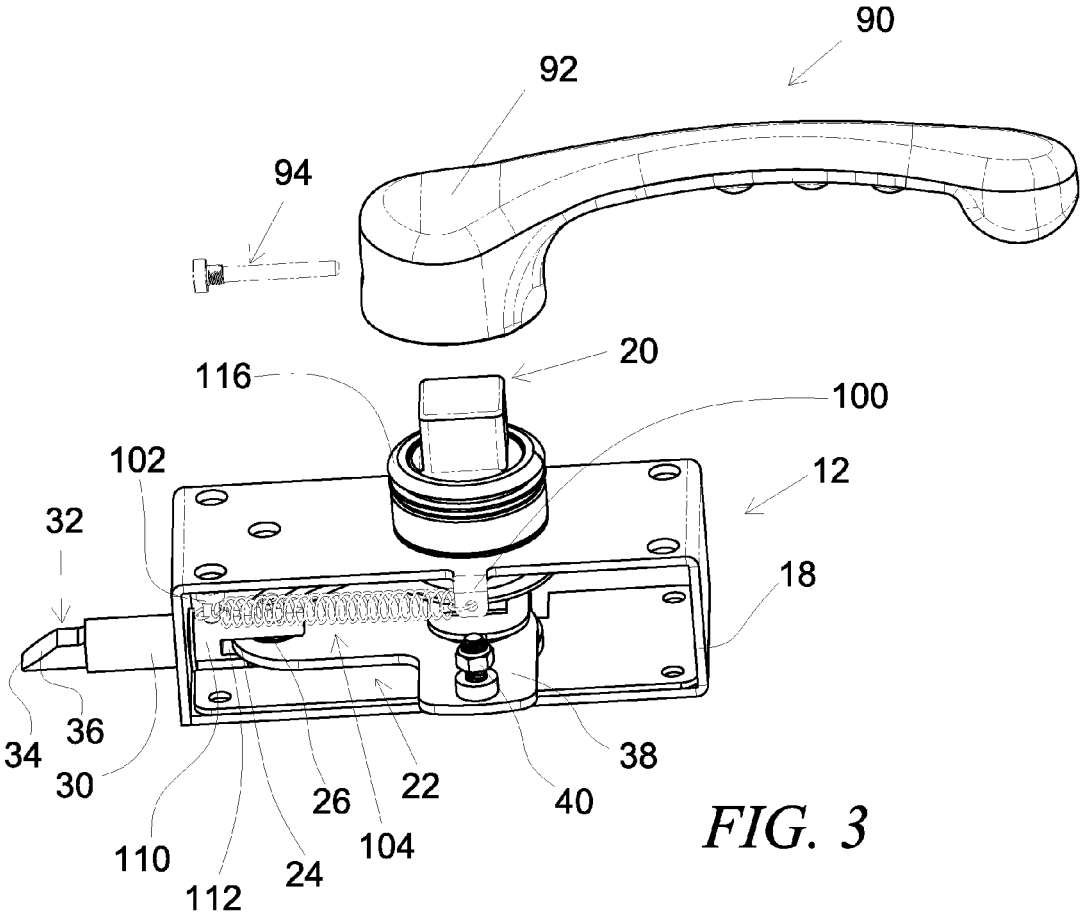
FIG. 3 is a bottom front isometric view of an exemplary embodiment of the master latch assembly (with handle shown in phantom) of FIG. 1A in a locked state.

Turning first to FIGS. 1A and 1B, there are shown front right isometric views of an exemplary embodiment a two point door latch with tapered pins 10 of the invention showing its master latch assembly 12 and its auxiliary latch assembly 14 joined by a linkage arm 16, in a locked state (FIG. 1A) and an unlocked state (FIG. 1B). The linkage arm 16 can be made of rigid material such metal rod or strip, or can be made of other materials, such as strong plastic, composites, or the like. The linkage arm 16 could also comprise a cable retain in a cable housing, or any other arrangement that will reliably translate motion between the master latch assembly 12 and its auxiliary latch assembly 14. The master latch assembly 12 has an outer housing 18 with a handle adapter 20 extending outside of the outer housing 18. A cam plate 22 is rotatably connected to the handle adapter 20, and includes an arched arm portion 24 with an arched slot 26 formed therein. The handle adapter 20 is rotatable relative to the outer housing 18. As shown in FIG. 3, a handle 90 attaches to the handle adapter 20 with a pin 94, which pin 94 passes through the handle 90 through a pin hole 96 formed in the handle adapter 20. Extending from a left end wall 28 of the outer housing 18 is a pin tube 30, through which pin tube 30 is extendable a master lock bolt 32. At distal end 34 of the master lock bolt preferably there is included a beveled face 36. Opposite the arched arm portion 24 of the cam plate 22 is an extension 38 with a master pivot 40. A first end 42 of the linkage arm 16 is pivotally connected to the pivot 40, such as with a nut 78. A second end 44 of the linkage arm 16 is pivotally connected to the auxiliary pivot 46, which auxiliary pivot 46 is connected to a proximal end 48 of an auxiliary bolt 50 of the auxiliary latch assembly 14. The auxiliary bolt 50 has a distal end 52 and preferably includes a beveled face 54. The auxiliary bolt 50 is slidably received in a bolt guide 56, with the bolt guide 56 being located in a bracket assembly 58. The bolt guide 56 can comprise a tube having a longitudinal slot 60 that extends at least partially along the length of the bolt guide 56 and preferably up to our near an upper end 62 of the bracket assembly 58, which has an bolt aperture 64 formed therein. The upper end 62 of the bracket assembly 58 connects to a bottom wall 66 thereof through side walls 68. A coil spring 70 is retained around the bolt guide 56, and seats with a bottom end 72 of the coil spring 70 resting on the bottom wall 66 of the bracket assembly 58. Attachment plates with holes 106 on the bracket assembly 58 can be provided to affix the auxiliary latch assembly 14 to a door. A top end 74 of the coil spring 70 impinges on a retention pin 76 or other stop device which is engaged with the auxiliary bolt 50. The thusly compressed coil spring 70 will tend to bias the auxiliary bolt 50 upwardly absent the force of the linkage arm 16 pushing it downwardly, and will thus act as an emergency auxiliary latch assembly 14 release in case the linkage arm 16 breaks or disconnects from the auxiliary latch assembly 14. As shown in the movement of the two point door latch with tapered pins 10 from the locked state of FIG. 1A to the unlocked state of FIG. 1B, when the handle adapter 20 is turned, it will rotate the cam plate 22, causing the master lock bolt 32 to withdraw into the master bolt tube 30, pulling up on the linkage arm 16 and pulling up on auxiliary bolt 50 so that an upper end 80 will pull through the bolt aperture 64 and its distal end 52 with beveled face 54 will be pulled upwardly into the bolt guide 56.

Figure 2A:
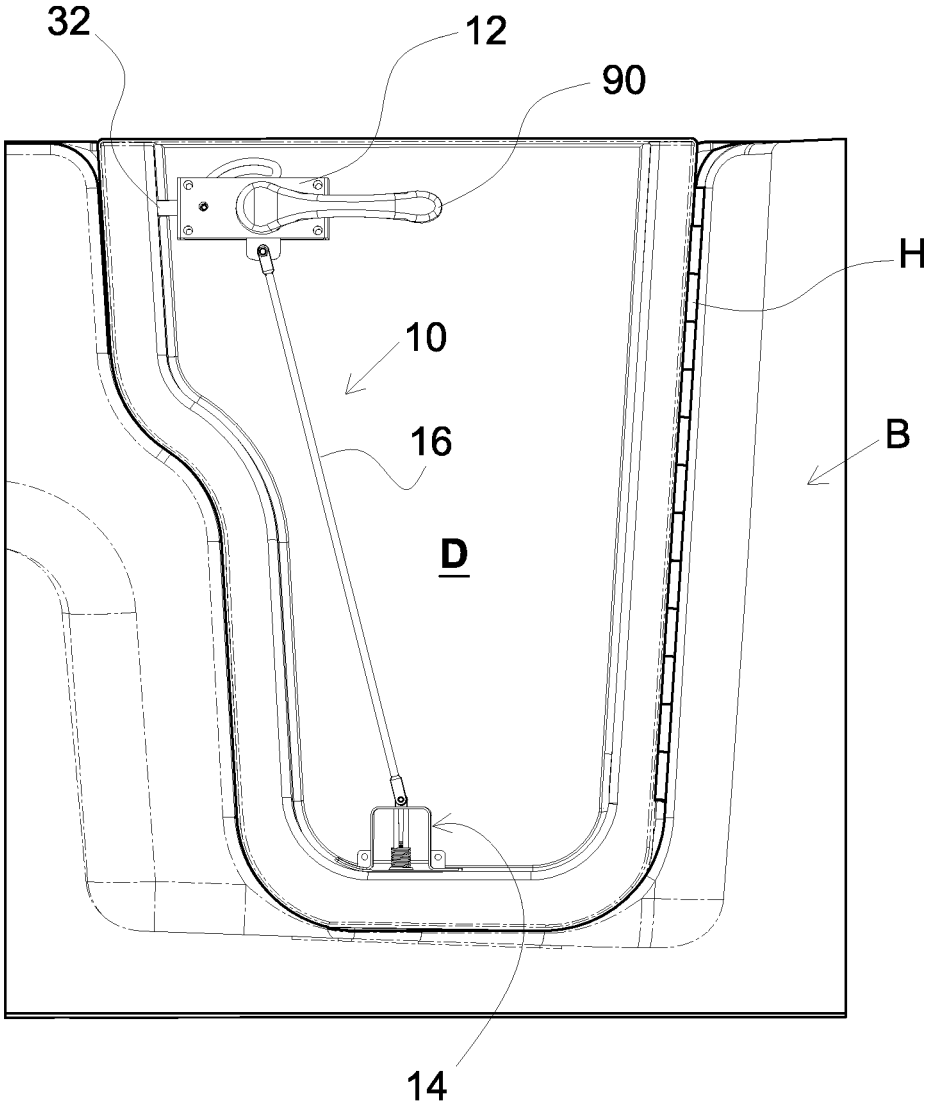
FIG. 2A is a partially exposed inside a bathtub view showing the two point door latch with tapered pins of the invention showing its master latch assembly and its auxiliary latch assembly in a door of a walk-in bathtub, with the door closed against the bathtub and with the assemblies in their locked state.

FIG. 2A is a partially exposed inside a bathtub view showing the two point door latch with tapered pins 10 of the invention showing its master latch assembly 12 and its auxiliary latch assembly 14 in a door D of a walk-in bathtub B, with the linkage arm 16 operationally joining the two assemblies, with the door D closed against the bathtub B and with the assemblies 12 and 14 in their locked state. The door D is attached to the bathtub B with a hinge H. The master bolt tube 30 can be seen as well as an exemplary handle 90 of the master latch assembly 12.

Figure 2B:
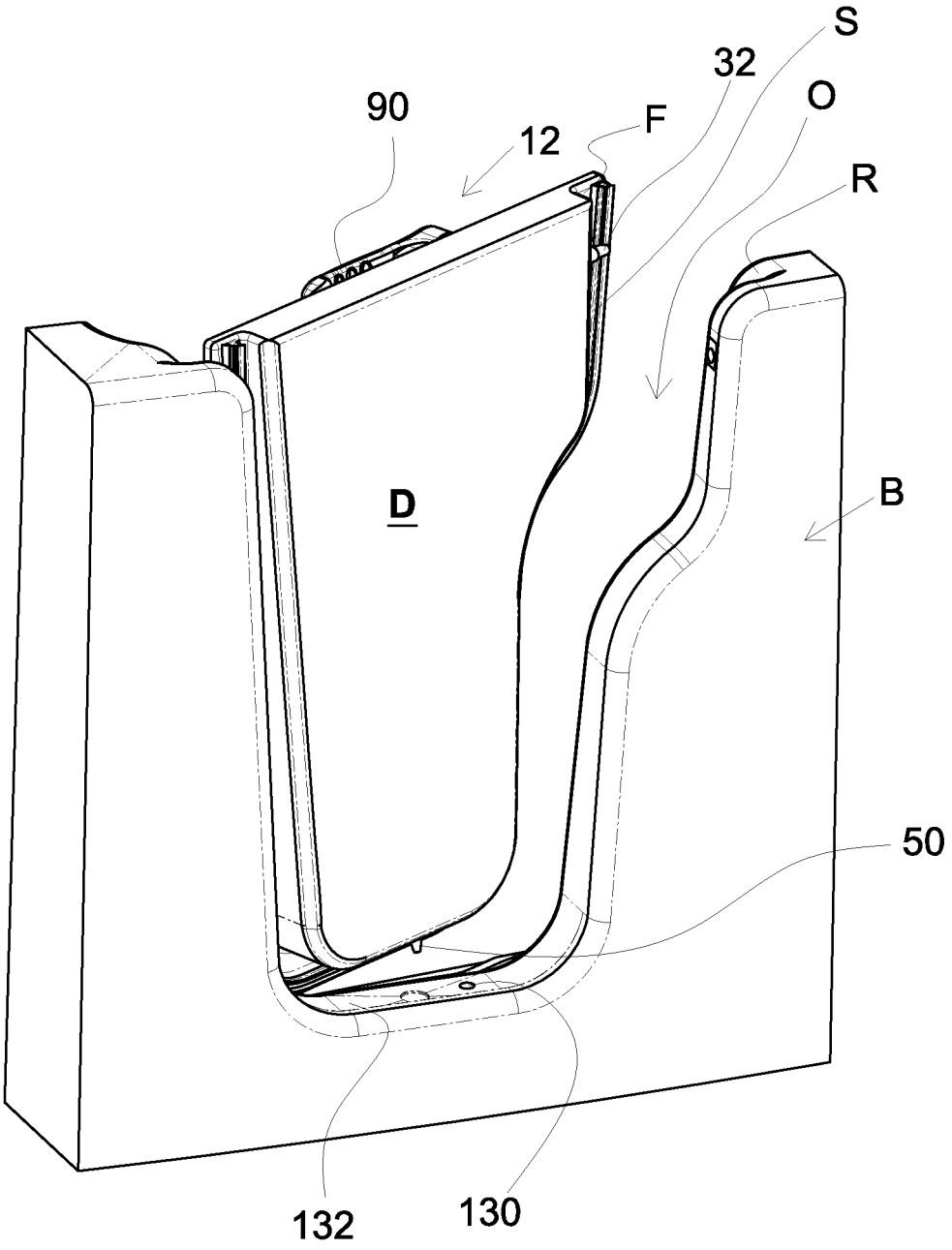
FIG. 2B is an outside a bathtub view showing the two point door latch with tapered pins of the invention showing the door of the walk-in bathtub partially opened.

FIG. 2B is an outside a bathtub view showing the two point door latch with tapered pins 10 of the invention showing the door D of the walk-in bathtub B partially opened. As can be seen the door D has a flange F around it perimeter, which flange F seats with a rim R around an opening O formed in the walk-in bathtub B. The master lock bolt 32 of the master latch assembly 12 and the auxiliary bolt 50 of the auxiliary latch assembly 14 are shown extending from the door D. A slam plate 130 is shown mounted on a sill 132 of the bathtub B. The slam plate 130 has a hole that receives the auxiliary bolt 50 of the auxiliary latch assembly 14 when the door D is closed on the bathtub B. Not shown but similarly situation is another slam plate that receives the master lock bolt 32 of the master latch assembly 12. A seal S is preferably located adjacent to the flange F of the door D so that when the door D is closed against the recess R of the opening in the bathtub B, the door D will water tightly seal in place.

FIG. 3 is a bottom front isometric view of an exemplary embodiment of the master latch assembly 12, but without the exemplary handle 90. The handle 90 has a head 92 that will be connected, e.g., via a pin 94 to the handle adapter 20, which is shown as having a square end. The handle's head 92 has a pin hole and a complementary engagement (not shown) which is aligned with a pin hole 96 in the handle adapter 20 (shown in FIG. 1A). The outer housing 18 has a spring retainer 100. Extending from the master lock bolt 32 is another spring retainer 102. A tension spring 104 is connected between the two spring retainers 100 and 102 and exerts a biasing force that tends to pull the master lock bolt 32 from its extended position, where its distal end 34 extends from the master bolt tube 30, inwardly back into the master bolt tube 30 absent any opposing force. A proximal end 110 of the master bolt tube 30 can preferably be forked and include a slot 112 formed therethrough, so that the slotted fork rides around the cam plate 22 in the vicinity of its arched slot 26. A guide pin 114 (best shown in FIGS. 5, 7 and 8) extends between the forked end bridging the slot 112 and being slidably retained in the arched slot 26 of the cam plate 22. A gasket 116 can be placed around on the handle adapter 20 to enhance the sealing of the master latch assembly 12 when it is attached to a door.

Figure 4:
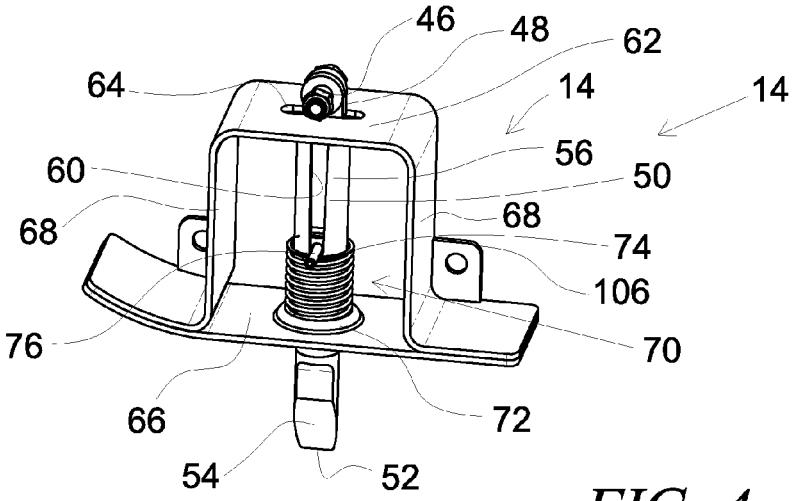
FIG. 4 is a top front isometric view of an exemplary embodiment of the auxiliary latch assembly of FIG. 1A in a locked state.

Turning to FIG. 4, there is shown a top front isometric view of an exemplary embodiment of the auxiliary latch assembly 14 of FIG. 1A in a locked state. The various features of the auxiliary latch assembly 14 are as described above with reference to FIGS. 1A and 1B, and include an auxiliary pivot 46, which auxiliary pivot 46 is connected to a proximal end 48 of an auxiliary bolt 50 of the auxiliary latch assembly 14. The auxiliary bolt 50 has a distal end 52 and preferably includes a beveled face 54. The auxiliary bolt 50 is slidably received in a bolt guide 56, with the bolt guide 56 being located in a bracket assembly 58. The bolt guide 56 can comprise a tube having a longitudinal slot 60 that extends at least partially along the length of the bolt guide 56 and preferably up to our near an upper end 62 of the bracket assembly 58, which has an bolt aperture 64 formed therein. The upper end 62 of the bracket assembly 58 connects to a bottom wall 66 thereof through side walls 68. A coil spring 70 is retained around the bolt guide 56, and seats with a bottom end 72 of the coil spring 70 resting on the bottom wall 66 of the bracket assembly 58. A top end 74 of the coil spring 70 impinges on a retention pin 76 which is engaged with the auxiliary bolt 50. The thusly compressed coil spring 70 will tend to bias the auxiliary bolt 50 upwardly absent the force of the linkage arm 16 pushing it downwardly, and will thus act as an emergency auxiliary latch assembly 14 release in case the linkage arm 16 breaks or disconnects from the auxiliary latch assembly 14.

Figure 5:
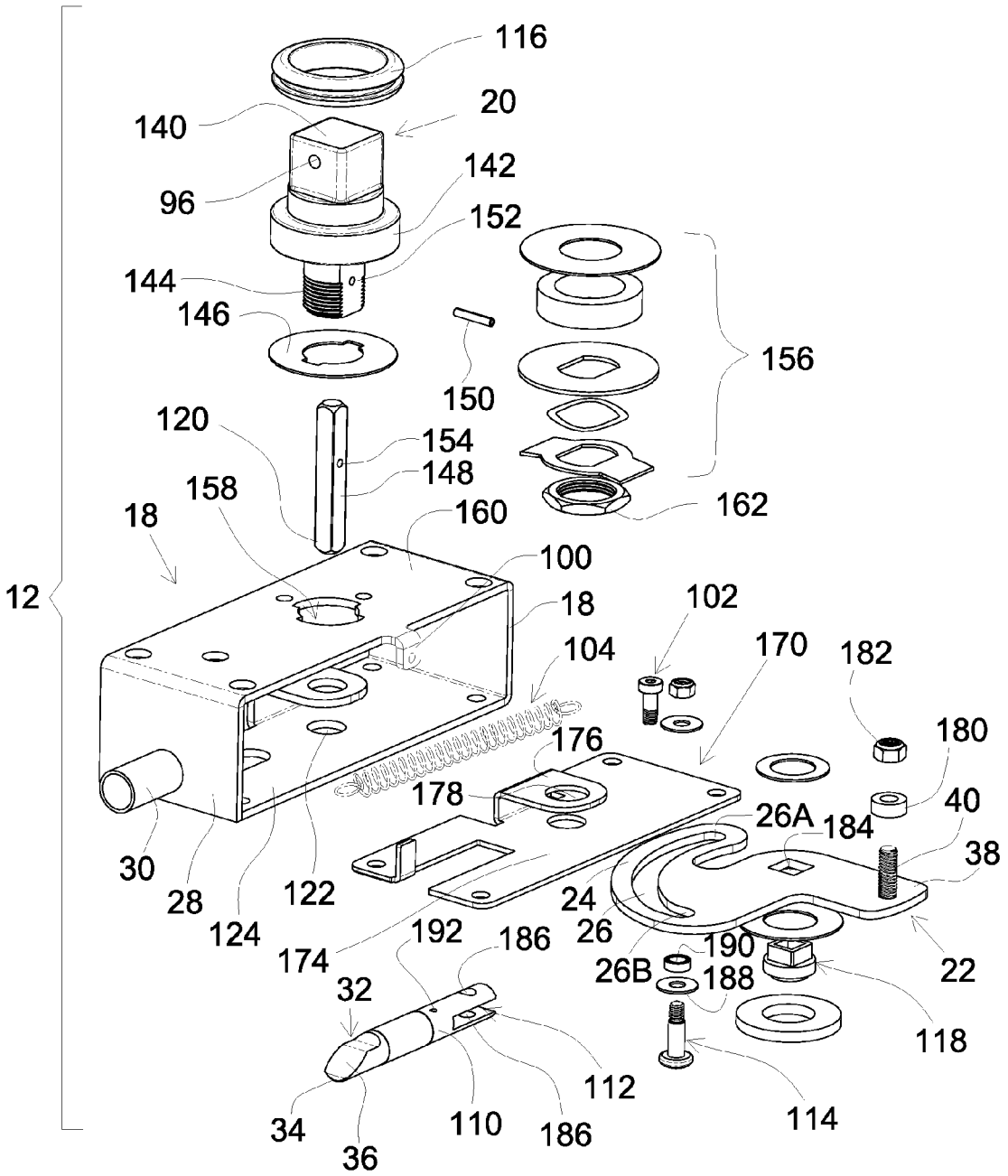
FIG. 5 is an exploded top right view of the master latch assembly of FIG. 3.

FIG. 5 is an exploded top right view of the master latch assembly 12 of FIG. 3. The handle adapter 20 is shown separated from the outer housing 18. The handle adapter has a square head 140, an enlarged collar 142 below the square head 140, and a threaded shank 144. The pin hole 96 is formed through the square head 140. The gasket 116 fits around the collar 142 and provides a seal on the door to which the master latch assembly 12 is attached. A spacer 146 made of low friction material, such as nylon, can be provided below the collar 142 on the threaded shank 144. A handle adapter shaft 148 slides into a hole (not shown) formed in the threaded shank 144 and is attached there with a shaft pin 150 that frictionally fits in a shank hole 152 and shaft hole 154 in the handle adapter shaft 148 to hold the handle adapter shaft 148 in place with the handle adapter 20 that that turning the handle adapter 20 turns the handle adapter shaft 148. The handle adapter shaft 148 has a non-round cross-section. In lieu of this construction, the handle adapter shaft 148 can be press fit into the threaded shank 144 or can be formed together with the threaded shank 144. A variety of spacers and washers 156 are provided for low friction operation of the handle adapter 20 relative to the outer housing 18. The outer housing 18 has a shaft hole 158 formed therein though a top surface 160 which passes the shaft 148. A threaded shaft nut 162 screws onto the threaded shank 144 and rotatably retains the handle adapter 20 in the shaft hole 158 of the outer housing 18. An internal housing frame 170 fits inside the outer housing 18. The outer housing 18 has an end wall 28 with the master bolt tube 30 passing therethrough. The internal housing frame 170 has a bottom wall 174 and a spaced apart top bracket 176. A through hole 178 is formed therethrough. The cam plate 22 is shown with its arched arm portion 24 with arched slot 26 formed therein, and extension 38. The master pivot 40, for example a threaded pin, extends upwardly from the extension 38. A spacer 180 and nut 182 are used to connect the cam plate 22 to the first end 42 of the linkage arm 16 as shown in FIGS. 1A and 1B. The cam plate 22 has a rotation hole 184 formed therein with is adapted to non-rotatably receive the handle adapter shaft 148, for example, by having a generally square shape to receive the generally square cross-section of the handle adapter shaft 148. The arched slot 26 has a first end 26A and a second end 26B. The first end 26A is closer to the rotation hole 184 than is the second end 26B to the rotation hole 184. Thus, when a camming action is set up when the cam plate 22 is rotated, as will be further described below. When fully assembled, the master lock bolt 32 will be positioned with its slot 112 around the arched arm portion 24 with arched slot 26 of the cam plate 22, with the guide pin 114 passing through the slot 112 in the proximal end 110 of the master lock bolt 32 and through slot hole 186 to pivotally attach the master lock bolt 32 to the cam plate 22. A washer 188 and nut 190 fix the guide pin 114 in place. When assembled, the cam plate 22 will be positioned in the internal housing frame 170 and the handle adapter shaft 148 will fit into the rotation hole 184 in the cam plate 22. Thus, turning the handle adapter 20 will turn the cam plate 22. The tension spring 104 will be connected at one end to the spring retainer 100 on the outer housing 18 and at its other end to the spring retainer 102, which spring retainer 102 can comprise a bolt, washer and nut and fit into a hole 192 forward of the slot hole 186 of the proximal end 110 of the master lock bolt 32. The spring 104 will thus tend to bias the master lock bolt 32 through the master bolt tube 30 and back into the master latch assembly 12. A handle shaft nut 118 is provided which non-rotatably slips over a distal end 120 of the handle adapter shaft 148. The handle shaft nut 118 will help retain the distal end 120 of the handle adapter shaft 148 in place when passed through the rotation hole 184 in the cam plate and rotatable fits within a base hole 122 formed in a bottom wall 124 of the outer housing 18. While an arched slot 26 in the cam plate 22 is a convenient guide for receiving the guide pin 114, instead of a slot, a raised guide or other arrangement can be used in lieu of a slot.

Figure 6:
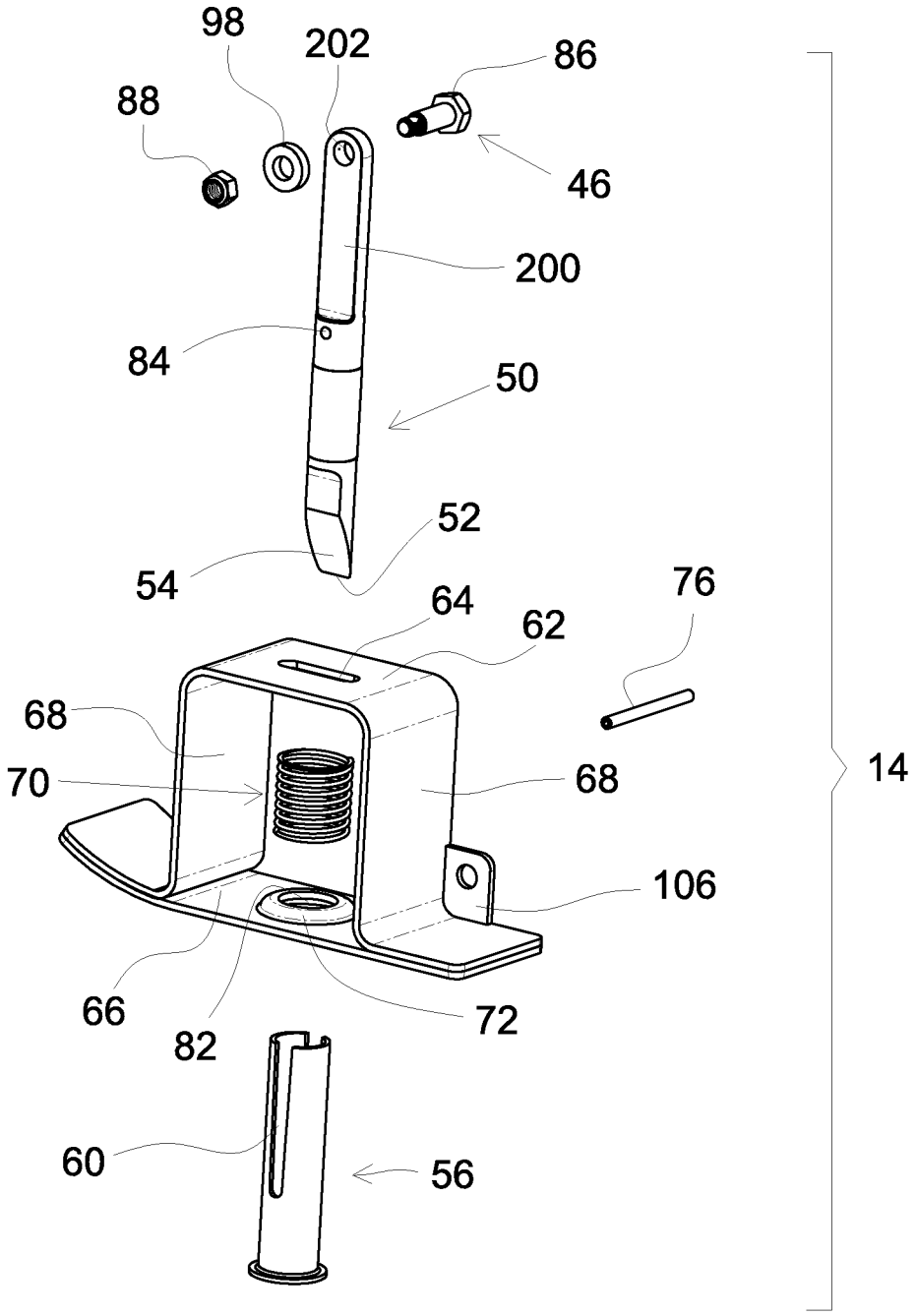
FIG. 6 is an exploded top right view of the exemplary auxiliary latch assembly of FIG. 4.

FIG. 6 is an exploded top right view of the exemplary auxiliary latch assembly 14 of FIG. 4. The various features of the auxiliary latch assembly 14 are as described above with reference to FIGS. 1A and 1B, and include an auxiliary pivot 46, which auxiliary pivot 46 is connected to a proximal end 48 of an auxiliary bolt 50 of the auxiliary latch assembly 14. The auxiliary bolt 50 has a distal end 52 and preferably includes a beveled face 54. The auxiliary bolt 50 is slidably received in a bolt guide 56, with the bolt guide 56 being located in a bracket assembly 58. The bolt guide 56 can comprise a tube having a longitudinal slot 60 that extends at least partially along the length of the bolt guide 56 and preferably up to our near an upper end 62 of the bracket assembly 58, which has an bolt aperture 64 formed therein. The upper end 62 of the bracket assembly 58 connects to a bottom wall 66 thereof through side walls 68. A coil spring 70 is retained around the bolt guide 56, and seats with a bottom end 72 of the coil spring 70 resting on the bottom wall 66 of the bracket assembly 58. A top end 74 of the coil spring 70 impinges on a retention pin 76 which is engaged with the auxiliary bolt 50. The thusly compressed coil spring 70 will tend to bias the auxiliary bolt 50 upwardly absent the force of the linkage arm 16 pushing it downwardly, and will thus act as an emergency auxiliary latch assembly 14 release in case the linkage arm 16 breaks or disconnects from the auxiliary latch assembly 14. The auxiliary bolt 50 is at its upper end 200 generally rectangular so as to slide through the bolt aperture 64 formed in the upper end 62 of the auxiliary latch assembly 14. An auxiliary bolt hole 82 is formed in the bottom wall 66 and receives the bolt guide 56 with its longitudinal slot 60. The retention pin 76 slides through the retention pin hole 84 formed in the auxiliary bolt 50. The auxiliary pivot 46 can comprise a bolt 86, nut 88, and spacer 98.

Figure 7:
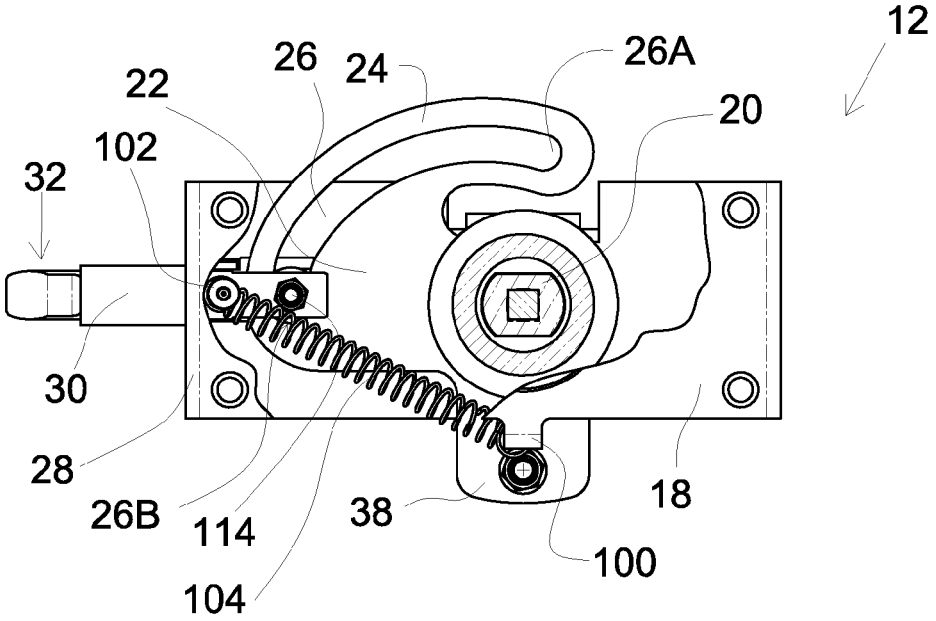
FIG. 7 is a partially exposed front plan view of the master latch assembly of FIG. 3 in its locked position.
Figure 8:
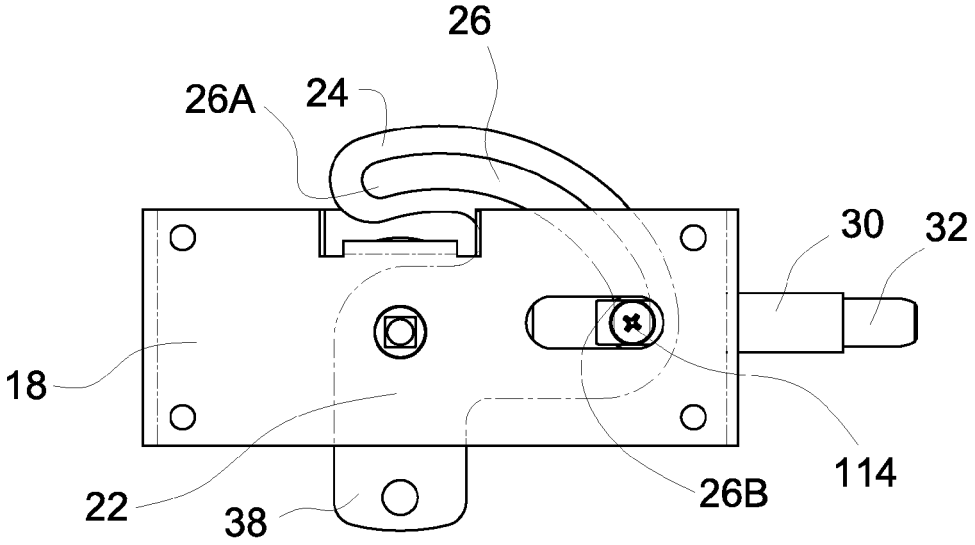
FIG. 8 is a partially exposed rear plane view of the master latch assembly of FIG. 3 in its locked position.
Figure 9:
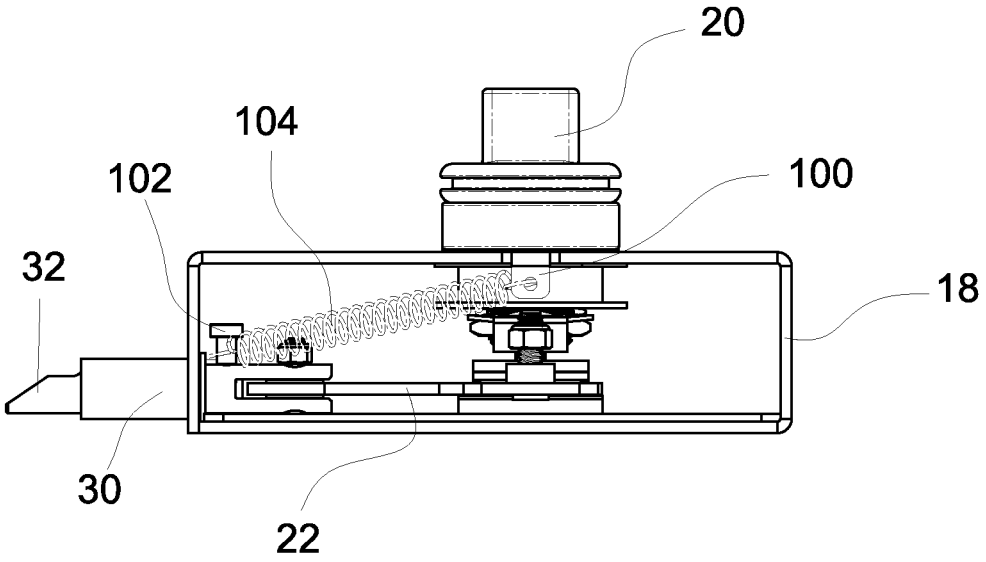
FIG. 9 is a bottom plane view of the master latch assembly of FIG. 3.
Figure 10:
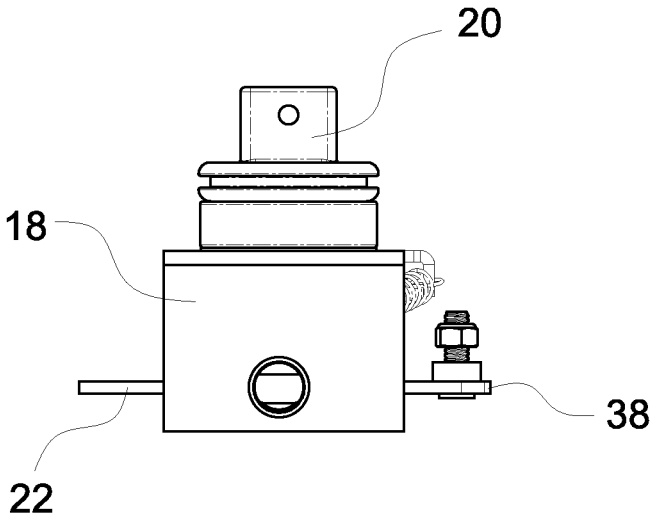
FIG. 10 is a right side view of the master latch assembly with handle of FIG. 3.

FIG. 7 is a partially exposed front plan view and FIG. 8 is a partially exposed rear plane view of the master latch assembly 12 of FIG. 3 in the locked position. FIG. 9 is a bottom plane view and FIG. 10 is a right side view of the master latch assembly 12 of FIG. 3 in the locked position. In this locked state, the master lock bolt 32 fully extends from the master bolt tube 30 extending from the left end wall 28 of the outer housing 18, and the cam plate 22 is rotated such that the guide pin 114 will abut against the second end 26B of the arched slot 26 in the arched arm portion 24 of the cam plate 22. As previously noted, the second end 26B is further away from the hole in the cam plate 22 (not shown) which is aligned with the handle adapter 20 compared to the first end 26A, and thus the master lock bolt 32 will allowed to extend from the master bolt tube 30. The spring 104 extends between the spring retainers 100 on the housing 18 and the spring retainer 102 on the master lock bolt 32 and absent the handle adapter 20 being held in its rotational position, tends to bias the master lock bolt 32 back into the master bolt tube 30 as shown in FIGS. 11-13.

Figure 11:
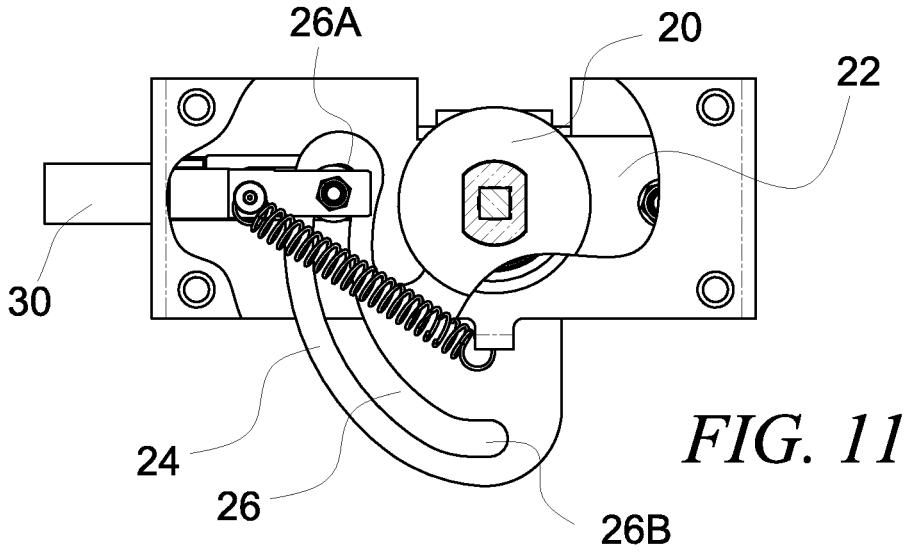
FIG. 11 is a partially exposed front plan view of the master latch assembly of FIG. 3 in its locked position, but in its unlocked state.
Figure 12:
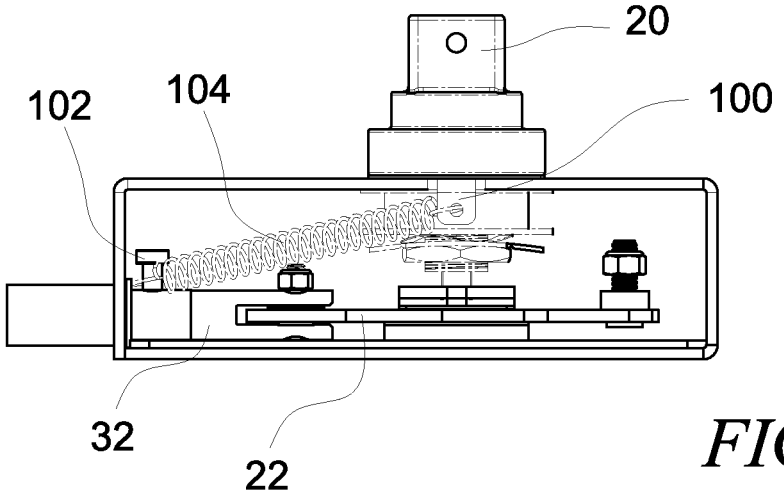
FIG. 12 is a bottom plan view of the master latch assembly of FIG. 11.
Figure 13:
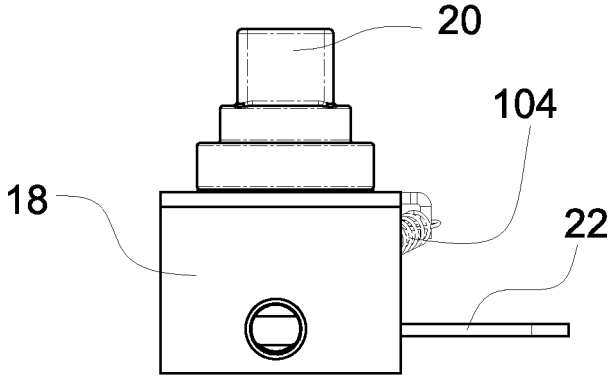
FIG. 13 is a right side view of the master latch assembly of FIG. 11.

FIG. 11 is a partially exposed front plan view, FIG. 12 is a bottom plan view, and FIG. 13 is a right side view of the master latch assembly 12 in an unlocked state. In this unlocked state, the master lock bolt 32 is withdrawn into the of the outer housing 18, and the cam plate 22 is rotated such that the guide pin 114 will abut against the first end 26A of the arched slot 26 in the arched arm portion 24 of the cam plate 22. As previously noted, the first end 26A is closer to the hole in the cam plate 22 (not shown) which is aligned with the handle adapter 20 compared to the second end 26B, and thus the master lock bolt 32 will be drawn into the master bolt tube 30 so as not to extend from the master bolt tube 30. The spring 104 extends between the spring retainers 100 on the housing 18 and the spring retainer 102 on the master lock bolt 32 and absent the handle adapter 20 being held in its rotational position, will tend to bias the master lock bolt 32 back into the master bolt tube 30 even if the handle adapter 20 is not turned to the open position.

Figure 14:
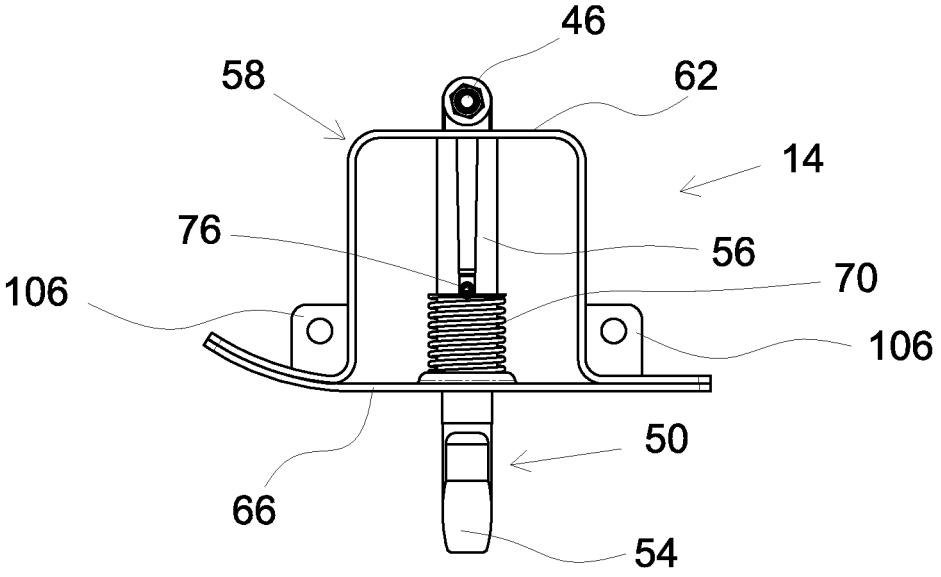
FIG. 14 is a front view of the auxiliary latch assembly of FIG. 1A with its auxiliary bolt fully extended.
Figure 15:
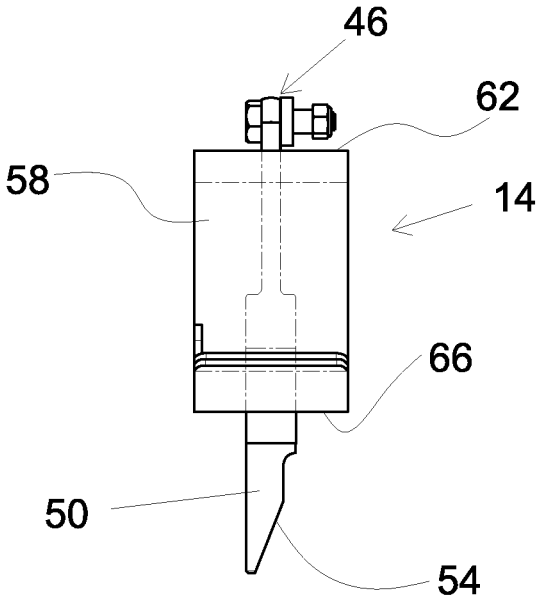
FIG. 15 is a right side view showing the auxiliary latch assembly of FIG. 1A with its auxiliary bolt extended fully.

FIG. 14 is a front view and FIG. 15 is a right side of the auxiliary latch assembly 14 of FIG. 1A with its auxiliary bolt 50 fully extended below the bottom wall 66 of the bracket assembly 58 and out of the bolt guide 56. In this state, the auxiliary pivot 46 is close to the upper end 62 of the auxiliary latch assembly 14. The coil spring 70 is compressed but tends to bias the auxiliary bolt 50 upwardly in the bolt guide 56 absent a force pushing it downwardly, viz., by the linkage arm 16 (not shown). The beveled face 54 of the auxiliary bolt 50 will be fully revealed in this state and available to engage with a slam plate 130 as shown in FIG. 2B. Indeed, the beveled face 54 of the auxiliary bolt 50 functions to gradually pull in a door as the auxiliary bolt 50 engaged with a slam plate, and thus ensures a water tight seal of the door with its bathtub opening.

Figure 16:
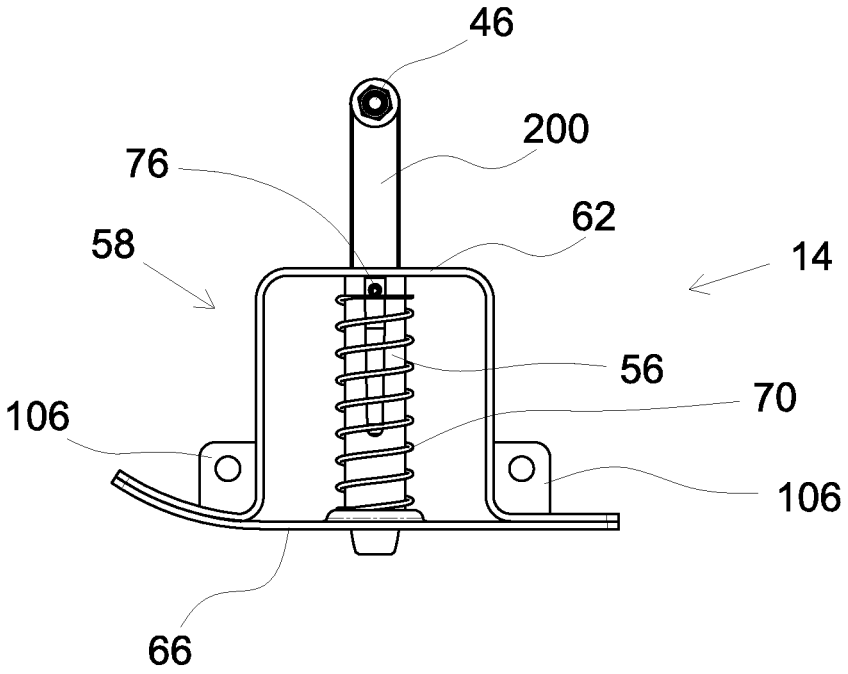
FIG. 16 is a front view of the auxiliary latch assembly of FIG. 1B with its auxiliary bolt fully retracted.

FIG. 15 is a right side view and FIG. 16 is a front view showing the auxiliary latch assembly 14 of FIG. 1A with its auxiliary bolt 50 retracted back into the bolt guide 56. In this state, the spring 70 is expanded between the bottom wall 66 and the retention pin 76. This is the state of the auxiliary latch assembly 14 when the handle on the master latch assemble is moved to its opened position or, if the linkage arm 16 (not shown) breaks or becomes disconnects, thereby ensuring that a sure can open the door.

Figure 17:
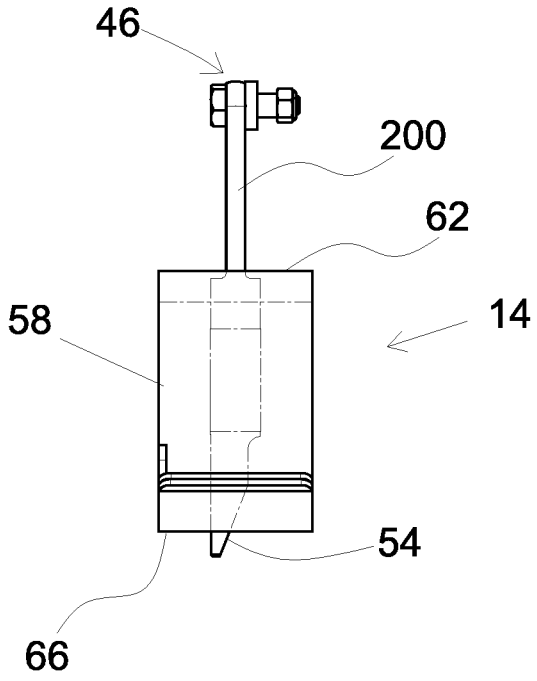
FIG. 17 is a right side view showing the auxiliary latch assembly of FIG. 16 with its auxiliary bolt fully retracted.

FIG. 16 is a front view and FIG. 17 is a right side view of the auxiliary latch assembly of FIG. 1B with its auxiliary bolt 50 retracted above the bottom wall 66 into the bracket assembly 58. When so withdrawn, its upper end 200 carrying the auxiliary pivot 46 will extend upwardly above the upper end 62, and its beveled face 54 no longer being able to engage a strike plate.

Figure 18:
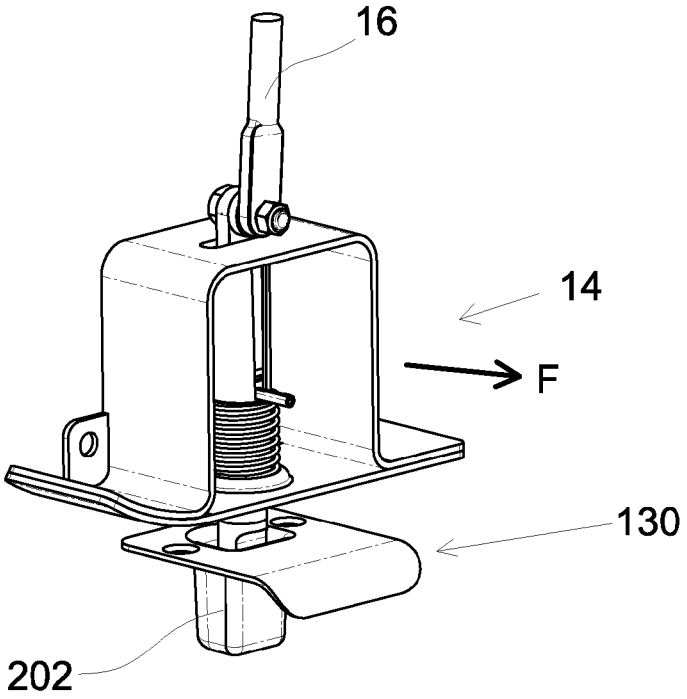
FIG. 18 is a left front isometric view of the auxiliary latch assembly with its auxiliary bolt engaged with a strike plate.
Figure 19:
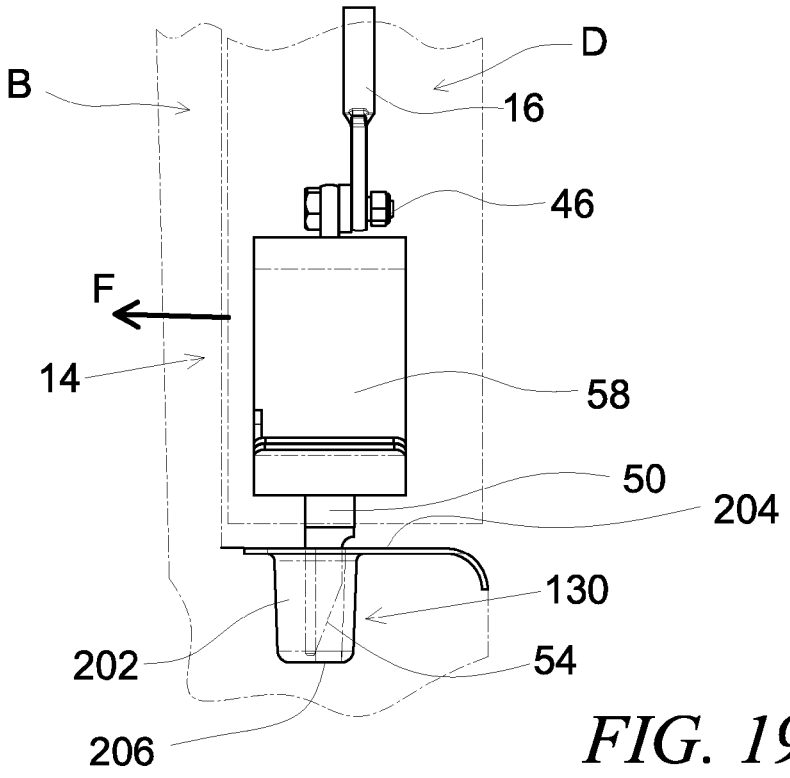
FIG. 19 is a partially exposed side view of the auxiliary latch assembly with its auxiliary bolt engaged with a strike plate.

FIG. 18 is a left front isometric view and FIG. 19 is a partially exposed side view of the auxiliary latch assembly 14 with its auxiliary bolt 50 extended into a cavity 202 of the slam plate 130. Indeed, as the auxiliary bolt 50 is moved into the cavity 202 from its upper surface 204 down towards the bottom 206, its beveled face 54 will act to move the auxiliary latch assembly 14 and its attached door D (a portion of which is shown in phantom lines) in the direction of the force arrow F towards the bathtub B (a portion of which is shown in phantom lines) to thereby ease the door D into place with the bathtub B.

Although the invention has been described with reference to a master latch assembly 12 and one auxiliary latch assembly 14, additional linkages can be connected to the master latch assembly 12 so that more than one auxiliary latch assembly 14 can be operated by the same master latch assembly 12. For example, if a design calls for three interoperated latches instead of two, simply adding one more auxiliary latch assembly 14 and a one more linkage 16 could easily be accommodated by the invention.

The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specifically described.

What is claimed is:

1. A two point door latch device, comprising:

a master latch assembly having (a) an outer housing, (b) a handle adapter that rotatably extends into the outer housing, (c) a master bolt with proximal end and a distal end, the master bolt slidably passing into the outer housing, the proximal end having a guide pin, (d) a cam plate with a rotation hole, an arch shaped slot with a first terminal end and a second terminal end, the first terminal end being further away from the rotation hole than is the second terminal end, and a master pivot, wherein the cam plate is rotatably retained within the outer housing and is rotationally connected to the handle adapter via the rotation hole in the cam plate, and (e) a tension spring that connects between the master bolt and the housing, which tension spring tends to bias the master bolt into the housing and rotate the cam plate to exert a pulling force on the linkage connected to the cam plate and tends to pull the auxiliary bolt into the bracket assembly and into an unlocked position, and wherein the guide pin of the master bolt slides in the arch shaped slot of the cam plate between the first terminal end of the arch-shaped slot wherein the master bolt moves into the outer housing, and the second terminal end of the arch-shaped slot wherein the master bolt moves out of the outer housing;

an auxiliary latch assembly having (a) a bracket assembly with a bottom wall and an upper end, (b) an auxiliary bolt with a proximal end having an auxiliary pivot thereon, and a distal end, the auxiliary bolt being slidable in the bracket assembly with proximal end extendable above the upper end of the bracket and the distal end extending below the bottom wall of the bracket assembly, and (c) a compression spring, which compression spring tends to bias the auxiliary bolt into the bracket assembly and exerts a pushing force on the linkage connected to the auxiliary pivot, thereby also tending to rotate the cam plate of the master latch assembly to draw the master bolt into the outer housing; and a separate linkage that connects between the master pivot of the master latch assembly and the auxiliary pivot of the auxiliary latch assembly and permits customizable spacing and alignment of the master latch assembly relative to the auxiliary latch assembly, wherein activation of the master latch assembly activates the auxiliary latch assembly, and wherein if either the guide pin or cam plate breaks then the tension spring will draw the master bolt back into the outer housing and if the linkage breaks, the compression spring will move the auxiliary bolt into the bracket assembly.

2. The two point door latch device of claim 1, wherein the auxiliary latch assembly further comprises a guide tube located in the bracket assembly between the bottom wall and the upper end, wherein the auxiliary bolt slides in the guide tube, and wherein the auxiliary bolt has a stop and wherein the compression spring is placed between the bottom wall and the stop to bias the auxiliary bolt into the bracket assembly, and wherein the auxiliary pivot at the proximal end of the auxiliary bolt extends through an opening formed in the upper end of the bracket assembly.

3. The two point door latch device of claim 1, wherein the master bolt and the auxiliary bolt have beveled distal ends.

4. The two point door latch device of claim 1, wherein the master latch assembly further comprises a handle connected to the handle adapter, which handle is used to operate both the master latch assembly and the auxiliary latch assembly.

5. The two point door latch device of claim 1, wherein the outer housing of the master latch assembly further comprise a master bolt tube extending from a side of the outer housing, wherein the master bolt slides in the master bolt tube and extends from the master bolt tube when in a locked state, and is retracted into the master bolt tube when in an unlocked state.

6. The two point door latch device of claim 1, wherein the master latch assembly further comprises a handle adapter shaft, which handle adapter shaft engages between the handle adapter and the cam plate.

7. The two point door latch device of claim 1, wherein the proximal end of the master bolt is formed with a slotted proximal end with the guide pin extending across the slot, and wherein the slotted proximal end slides on cam plate with the guide pin passing through the arch-shaped slot to connect the master bolt to the cam plate.

8. A two point door latch device, comprising:

a master latch assembly having (a) a housing, (b) a handle adapter that passes into the housing, (c) a master bolt with proximal end and a distal end, the distal end having a beveled face, the master bolt slidably passing into the housing, (d) a cam plate with a rotation hole, a guide with a first end and a second end, the first end being spaced further away from the rotation hole than is the second end, and a master guide follower, wherein the cam plate is rotatably retained within the housing and is connected to the handle adapter via the rotation hole in the cam plate, and (e) a tension spring that connects between the master bolt and the housing, which tension spring tends to bias the master bolt into the housing and rotate the cam plate to exert a pulling force on the linkage connected to the cam plate and tends to pull the auxiliary bolt into the bracket assembly and into an unlocked position, and wherein the proximal end of the master bolt slides relative to the guide of the cam plate between the first end where the master bolt moves into the outer housing, and the second end where the master bolt moves out of the housing;

an auxiliary latch assembly having (a) a bracket assembly with a bottom wall and an upper end, (b) an auxiliary bolt with a proximal end having an auxiliary pivot thereon, and a distal end with a beveled face, the auxiliary bolt being slidable in the bracket assembly with proximal end extendable above the upper end of the bracket and the distal end extending below the bottom wall of the bracket assembly, and (c) a compression spring, which compression spring tends to bias the auxiliary bolt into the bracket assembly and exerts a pushing force on the linkage connected to the auxiliary pivot, thereby also tending to rotate the cam plate of the master latch assembly to draw the master bolt into the outer housing; and a separate linkage that connects between the master pivot of the master latch assembly and the auxiliary pivot of the auxiliary latch assembly, wherein activation of the master latch assembly activates the auxiliary latch assembly, and wherein if either the guide pin or cam plate breaks then the tension spring will draw the master bolt back into the outer housing and if the linkage breaks, the compression spring will move the auxiliary bolt into the bracket assembly.

9. The two point door latch device of claim 8, wherein the guide in the cam plate comprise an arch-shaped slot formed in the cam plate, and wherein the proximal end of the master bolt is formed with a slotted proximal end that has a guide pin extending across the slot, wherein the slotted proximal end slides on cam plate with the guide pin passing through the arch-shaped slot to connect the master bolt to the cam plate.

10. The two point door latch device of claim 8, wherein the master latch assembly further comprises a handle connected to the handle adapter, which handle is used to operate both the master latch assembly and the auxiliary latch assembly.

11. A two point door latch device, comprising:

a master latch assembly having (a) an outer housing, (b) a handle adapter that rotatably extends into the outer housing, (c) a master bolt with proximal end and a distal end, the master bolt slidably passing into the outer housing, the proximal end having a guide pin, (d) a tension spring that connects between the master bolt and the housing, which tension spring tends to bias the master bolt into the housing and rotate the cam plate to exert a pulling force on the linkage connected to the cam plate and tends to pull the auxiliary bolt into the bracket assembly and into an unlocked position, and (e) a cam plate with a rotation hole, an arch shaped slot with a first terminal end and a second terminal end, the first terminal end being further away from the rotation hole than is the second terminal end, and a master pivot, wherein the cam plate is rotatably retained within the outer housing and is rotationally connected to the handle adapter via the rotation hole in the cam plate, and wherein the guide pin of the master bolt slides in the arch shaped slot of the cam plate between the first terminal end of the arch-shaped slot wherein the master bolt moves into the outer housing, and the second terminal end of the arch-shaped slot wherein the master bolt moves out of the outer housing, an auxiliary latch assembly having (a) a bracket assembly with a bottom wall and an upper end, (b) an auxiliary bolt with a proximal end having an auxiliary pivot thereon, and a distal end, the auxiliary bolt being slidable in the bracket assembly with proximal end extendable above the upper end of the bracket and the distal end extending below the bottom wall of the bracket assembly, and (c) a tension spring that connects between the master bolt and the housing, which tension spring tends to bias the master bolt into the housing and rotate the cam plate to exert a pulling force on the linkage connected to the cam plate and tends to pull the auxiliary bolt into the bracket assembly and into an unlocked position; and a separate linkage that connects between the master pivot of the master latch assembly and the auxiliary pivot of the auxiliary latch assembly and permits customizable spacing and alignment of the master latch assembly relative to the auxiliary latch assembly, wherein activation of the master latch assembly activates the auxiliary latch assembly, and wherein if either the guide pin or cam plate breaks then the tension spring will draw the master bolt back into the outer housing and if the linkage breaks, the compression spring will move the auxiliary bolt into the bracket assembly.

12. The two point door latch device of claim 11, wherein the master bolt and the auxiliary bolt have beveled distal ends.

13. The two point door latch device of claim 11, wherein the master latch assembly further comprises a handle connected to the handle adapter, which handle is used to operate both the master latch assembly and the auxiliary latch assembly.

14. The two point door latch device of claim 11, wherein the proximal end of the master bolt is formed with a slotted proximal end with the guide pin extending across the slot, and wherein the slotted proximal end slides on cam plate with the guide pin passing through the arch-shaped slot to connect the master bolt to the cam plate.

* * * * *